US008528830B2

(12) United States Patent
Froehlich et al.

(10) Patent No.: US 8,528,830 B2
(45) **Date of Patent: *Sep. 10, 2013**

(54) METHODS AND SYSTEM FOR COOLING A REACTION EFFLUENT GAS

(75) Inventors: Robert Froehlich, New Providence, NJ (US); David Mixon, Port Murray, NJ (US)

(73) Assignee: Jiangsu Zhongneng Polysilicon Technology Development Co., Ltd., Jiangsu Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/543,188

(22) Filed: Jul. 6, 2012

(65) Prior Publication Data

US 2012/0267441 A1 Oct. 25, 2012

Related U.S. Application Data

(63) Continuation of application No. 12/763,557, filed on Apr. 20, 2010, now Pat. No. 8,235,305.

(60) Provisional application No. 61/170,983, filed on Apr. 20, 2009.

(51) Int. Cl.
*G05D 23/13* (2006.01)
*C01B 33/00* (2006.01)

(52) U.S. Cl.
USPC ..... 236/12.1; 423/324; 62/617

(58) Field of Classification Search
USPC ..... 236/1 C, 12.1; 423/324, 348, 349; 438/758; 62/617, 620
See application file for complete search history.

(56) References Cited

U.S. PATENT DOCUMENTS

| | | | | |
|---|---|---|---|---|
| 7,708,970 | B2 * | 5/2010 | Hesse et al. | 423/349 |
| 2009/0060819 | A1 * | 3/2009 | Bill et al. | 423/342 |
| 2011/0000257 | A1 * | 1/2011 | Gadre et al. | 62/617 |

* cited by examiner

*Primary Examiner* — Marc Norman
(74) *Attorney, Agent, or Firm* — Greenberg Traurig, LLP

(57) ABSTRACT

In one embodiment, a method for cooling a reaction effluent gas includes feeding a sufficient amount of a suitable silicon source cooling gas into a stream of the reaction effluent gas, wherein the reaction effluent gas is produced by a thermal decomposition of at least one silicon source gas in a reactor, and wherein sufficient amount of the suitable silicon source cooling gas is defined based a concentration of the at least one chemical species in the reaction effluent gas; cooling the reaction effluent gas to a sufficient temperature so that: the cooled reaction effluent gas is capable of being handled by a material that is not suitable for handling the reaction effluent gas.

3 Claims, 3 Drawing Sheets

METHODS AND SYSTEM FOR COOLING A REACTION EFFLUENT GAS

RELATED APPLICATIONS

This application is a continuation of U.S. application Ser. No. 12/763,557," filed Apr. 20, 2010, entitled "METHODS AND SYSTEM FOR COOLING A REACTION EFFLUENT GAS", which claims the benefit of U.S. provisional application Ser. No. 61/170,983 filed Apr. 20, 2009, and entitled "GAS QUENCHING SYSTEM FOR FLUIDIZED BED REACTOR," which are hereby incorporated herein by reference in their entirety for all purposes.

BACKGROUND OF THE INVENTION

Multitude of chemical reactions proceed at temperatures that exceed 300 degrees Celsius. Often, these reactions involve gaseous compounds, and/or generate gaseous products and/or by-products. Some industrial processes require cooling gases exiting a reaction environment.

BRIEF SUMMARY OF THE INVENTION

In one embodiment, a method for cooling a reaction effluent gas includes delivering a suitable cooling gas into a stream of the reaction effluent gas, wherein the stream of the reaction effluent is traveling in a confined environment, wherein the reaction effluent gas comprises at least one first compound, and wherein the suitable cooling gas comprises at least one second compound wherein a combined mixture of the reaction effluent gas and the suitable cooling gas is cooled to a temperature of more than 425 degrees Celsius; wherein an approximate desirable temperature of the combined gaseous mixture is defined by at least one of the following: 1) a rate of the reaction effluent gas, 2) a rate of at least one first compound, 3) a rate of the suitable cooling gas, 4) a rate of the at least one second compound, 5) a cross-section of the confined environment, 6) a directional degree at which the suitable cooling gas is delivered into the stream of the reaction effluent gas, wherein the directional degree is defined based on an axis along which the steam of the reaction effluent gas is generally advances; 7) a pressure of the reaction effluent gas, 8) a pressure of the suitable cooling gas, 9) a composition of the reaction effluent gas, 10) a composition of the suitable cooling gas, 11) a temperature of the reaction effluent gas, 12) a temperature of the suitable cooling gas, and 13) the approximate desirable temperature.

In some embodiments, a method of the instant invention for cooling a reaction effluent gas, includes a) feeding a sufficient amount of a suitable silicon source cooling gas into a stream of the reaction effluent gas, i) wherein the reaction effluent gas is produced by a thermal decomposition of at least one silicon source gas in a reactor, ii) wherein the stream of the reaction effluent is traveling in a confined area, iii) wherein the suitable silicon source cooling gas comprises at least one chemical species that is present in the reaction effluent gas, and iv) wherein sufficient amount of the suitable silicon source cooling gas is defined based a concentration of the at least one chemical species in the reaction effluent gas; b) cooling the reaction effluent gas to a sufficient temperature so that: i) the rate of the thermal decomposition of the at least one silicon source gas in the stream of the cooled reaction effluent gas is less than 5 percent, and ii) the cooled reaction effluent gas is capable of being handled by a material that is not suitable for handling the reaction effluent gas; and c) wherein the sufficient temperature is temperature range between about 450 degrees Celsius and about 700 degrees Celsius.

In some embodiments, the confined area is located outside of the reactor. In some embodiments, the confined area is located inside of the reactor.

BRIEF DESCRIPTION OF THE SEVERAL VIEWS OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

Figure 1:
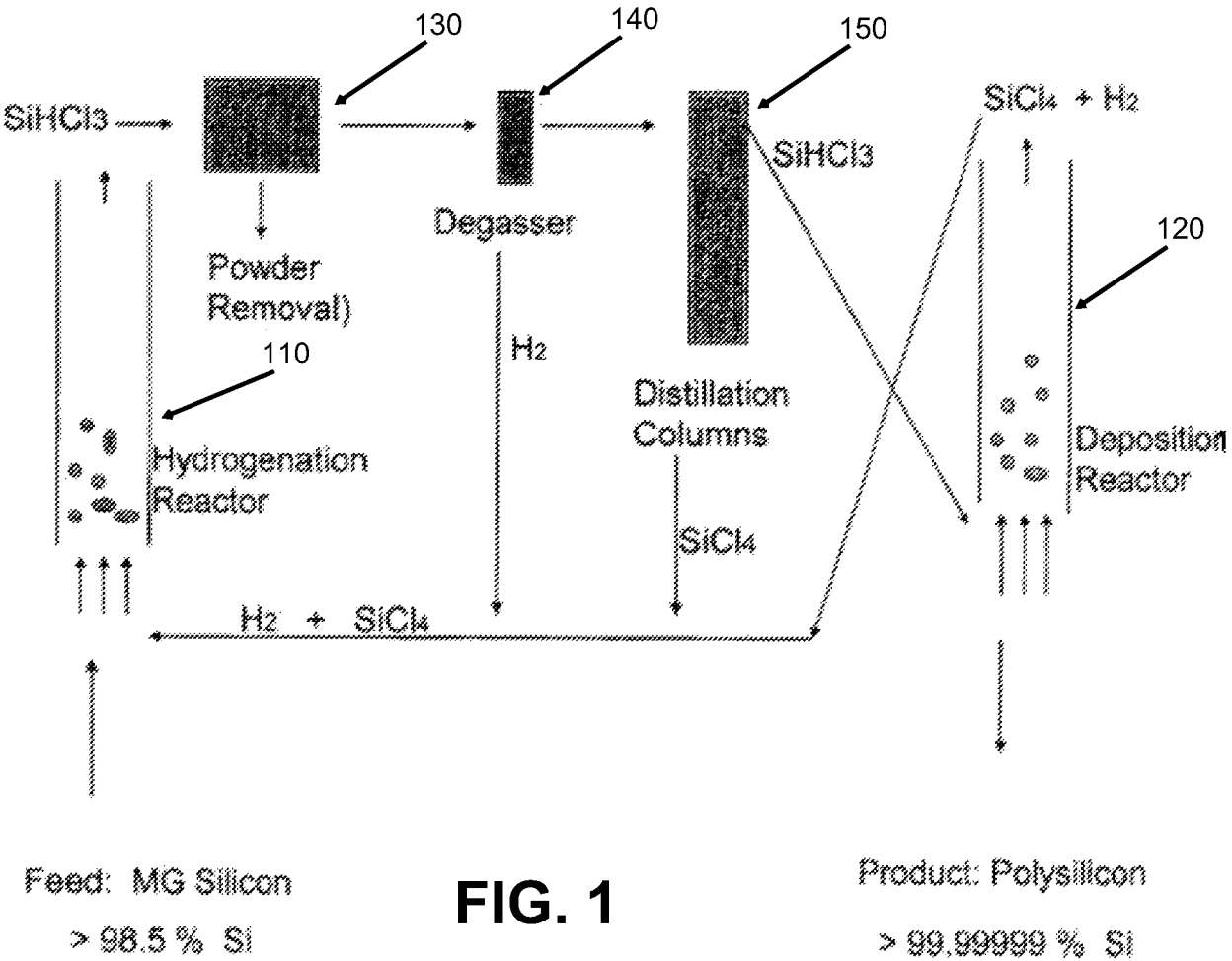
FIG. 1 shows an embodiment of a process in which an embodiment of the present invention is utilized.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed invention.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

In an embodiment, the present invention allows the use of readily available and relatively less expensive metal alloys in material-of-construction for downstream (efferent) items of equipment. In another embodiment, the instant invention provides immediate and sufficient gas cooling of the reactor overhead effluent gas upon exiting the reaction zone of a reactor and/or after exiting reactor so as to allow for the use of readily available, relatively inexpensive alloy metal construction of not-reactive zones of a reactor and/or downstream equipment.

Examples of the application of the instant invention to processes for production of polysilicon, as further discussed herein, are provided simply for illustrative purposes, and therefore should not be deemed limiting with respect to another application, unrelated to the production of polysilicon, to which the instant invention can be readily applied based on the same or similar principles and/or conditions discussed herein.

Highly pure polycrystalline silicon ("polysilicon") is a starting material for the fabrication of electronic components and solar cells. It is obtained by thermal decomposition of a silicon source gas or reduction, with hydrogen, of a silicon source gas.

For the purposes of describing and claiming the present invention, the following terms are defined:

"Silane" means: any gas with a silicon-hydrogen bond. Examples include, but are not limited to, $SiH_4$; $SiH_2Cl_2$; $SiHCl_3$.

"Silicide" means: a compound that has silicon in conjunction with more electropositive elements; in one example, a compound comprising at least a silicon atom and a metal atom, including, but not limited to, $Ni_2Si$; NiSi; $CrSi_2$; $FeSi_2$.

"Silicon Source Gas" means: Any silicon-containing gas utilized in a process for production of polysilicon; in one embodiment, any silicon source gas capable of reacting with an electropositive material and/or a metal to form a silicide.

"STC" means silicon tetrachloride ($SiCl_4$).

"TCS" means trichlorosilane ($SiHCl_3$).

"Latent Heat" means: the amount of energy released or absorbed by a chemical substance during a change of state (i.e. solid, liquid, or gas), or a phase transition.

"Sensible Heat" means: the heat given to a body, when the body is in such a state that the heat gained by it does convert to latent heat, or the energy supplied is not used up to change the state of the system (as in latent heat, e.g. from solid to gas)).

A chemical vapor deposition (CVD) is a chemical process that is used to produce high-purity solid materials. In a typical CVD process, a substrate is exposed to one or more volatile precursors, which react and/or decompose on the substrate surface to produce the desired deposit. Frequently, volatile by-products are also produced, which are removed by gas flow through the reaction chamber. A process of reducing with hydrogen of trichlorosilane ($SiHCl_3$) is a CVD process, known as the Siemens process. The chemical reaction of the Siemens process is as follows:

$$SiHCl_3(g)+H_2 \rightarrow Si(s)+3HCl(g)$$ ("g" stands for gas; and "s" stands for solid)

In the Siemens process, the chemical vapor deposition of elemental silicon takes place on silicon rods, so called thin rods. These rods are heated to more than 1000 C under a metal bell jar by means of electric current and are then exposed to a gas mixture consisting of hydrogen and a silicon source gas, for example trichlorosilane (TCS). As soon as the thin rods have grown to a certain diameter, the process has to be interrupted, i.e. only batch wise operation rather than continuous operation is possible.

Some embodiments of the present invention are utilized to obtain highly pure polycrystalline silicon as granules, hereinafter referred to as "silicon granules," in fluidized bed reactors in the course of a continuous CVD process of the thermal decomposition of a silicon source gas. The fluidized bed reactors are often utilized, where solid surfaces are to be exposed extensively to a gaseous or vaporous compound. The fluidized bed of granules exposes a much greater area of silicon surface to the reacting gases than it is possible with other methods of CVD process. A silicon source gas, such as $HSiCl_3$, is utilized to perfuse a fluidized bed comprising polysilicon particles. These particles as a result, grow in size to produce granular polysilicon.

Detailed embodiments of the present invention are disclosed herein; however, it is to be understood that the disclosed embodiments are merely illustrative of the invention that may be embodied in various forms. For instance, the disclosure of various embodiments of the present invention for application in processes of silicon deposition serves only as an illustration of the principals of the present invention and some specific applications, but the present invention may also be applied for other conditions (e.g. the Siemens process), environments, and/or reactions that may exhibit at least some of characteristics (e.g. thermal stability, reactive inertness, corrosion resistance, etc.) that are similar to at least one characteristic of the polysilicon process.

In an embodiment, a suitable silicon source gas includes, but not limited to, at least one of $H_xSi_yCl_z$, wherein x, y, and z is from 0 to 6.

In one embodiment, due to the relatively high temperatures required for effective deposition rates (600-980 degrees Celsius) and the highly corrosive nature of the chlorine component of the effluent gases exiting the reactor or the reaction zone of the reactor, the instant invention allows to avoid using only quartz or a few exotic and costly high alloy metals, or similar materials, as material-of-construction for downstream reactor's zones and items of other equipment, and provides sufficient cooling of the gases so as to allow for the use of readily available and relatively less expensive metal alloys, ceramics, or other similar materials.

In one embodiment, the use of sensible, rather than latent heat, of an effluent-compatible gas is utilized so as to cool a high-temperature gas effluent and facilitate use of less expensive and/or fragile material for passage and/or storage of such cooled effluent.

In one embodiment, the instant invention can be applied to sufficiently cool the effluent gas stream exiting the reaction zone of the reactor to a temperature at which gaseous fractions within the effluent stream are no longer significantly react among themselves and/or decompose (a reaction rate of less than 5% of the reaction rate in the reaction zone). In one embodiment, feeding STC into a stream of effluent gas of the TCS thermal decomposition, substantially lowers the amount and/or eliminates completely any TCS decomposition that may still proceed within the effluent stream.

In one embodiment, the present invention provides for cooling of gases produced when a silicon source gas, such as TCS, is introduced into a reactor and at a certain temperature, decomposes in accordance with the following chemical formula (M stands for Poly-Si beads):

$$4\ HSiCl_3+(M) \rightarrow Si(M)+3\ SiCl_4+H_2 \quad (1)$$

The thermal decomposition is the separation or breakdown of a chemical compound into elements or simpler compounds at a certain temperature.

An embodiment of the thermal decomposition of a silicon source gas is shown in FIG. 1. In an embodiment, metallurgical grade silicon is fed into a hydrogenation reactor 110 with sufficient proportions of TCS, STC and $H_2$ to generate TCS. TCS is then purified in a powder removal step 130, degasser step 140, and distillation step 150. The purified TCS is fed into a decomposition reactor 120, where TCS decomposes to deposit silicon on beads (silicon granules) of the fluidized bed reactor. Produced STC and $H_2$ are recycled in to the hydrogenation reactor 110.

In one embodiment, the present invention is directed to a method to reduce the temperature of gases exiting a reactor or exiting a reaction zone of a reactor, so that, subsequent to cooling, the gases can be handled by equipment made from a relatively common alloy, such as Hastelloy C-276 (maximum use as an ASME coded reactor at 676 degrees Celsius). In one embodiment, the reactor effluent gasses have a temperature exceeding 700 degrees Celsius.

In one embodiment, due to the relatively high temperatures required for effective deposition rates, the highly corrosive nature of the chlorine component of the silicon source gas and the extremely stringent purity requirements of the product, limited reactor reactor wall materials and afferent and efferent reactor access materials have been considered to date for this application.

In one embodiment, TCS is introduced to a reactor held at a temperature of 600 C for a time sufficient to decomposed TCS. In some embodiments, the decomposition reaction (1) is conducted at temperatures below 900 degrees Celsius. In some embodiments, the decomposition reaction (1) is conducted at temperatures below 1000 degrees Celsius. In some embodiments, the decomposition reaction (1) is conducted at temperatures below 800 degrees Celsius.

In some embodiments, the decomposition reaction (1) is conducted at temperatures between 650 and 942 degrees Celsius. In some embodiments, the decomposition reaction (1) is conducted at temperatures between 650 and 850 degrees Celsius.

In some embodiments, the decomposition reaction (1) is conducted at temperatures between 650 and 800 degrees Celsius.

In some embodiments, the decomposition reaction (1) is conducted at temperatures between below 700 and 900 degrees Celsius.

In some embodiments, the decomposition reaction (1) is conducted at temperatures between below 700 and 800 degrees Celsius.

In one embodiment, the cooling gas is introduced at a lower temperature than the reactor effluent gas relative to the temperature of the reactor effluent gas when initially exiting the reactor.

In one embodiment, the reactor itself is a high temperature alloy, such as alloy HR-160 or Inconel 617 (in one embodiment, maximum use as an ASME ("The American Society of Mechanical Engineers") coded reactor 982 degrees Celsius). In another embodiment, the reactor is a quartz reactor (in one embodiment, maximum use up to 1000 degrees Celsius).

In one embodiment, a method involves feeding a relatively cool gas stream of silicon tetrachloride (at about 115 degrees Celsius) or other gas suitable for such gas cooling and compatible with the gaseous effluent to be cooled into the hot reactor gas effluent stream.

In one embodiment, a device is attached to a quartz reactor upstream, through the use of a cooled ball-and-socket/o-ring connection. In another embodiment, a device is attached to a metal reactor upstream, using a gasket and flange.

In one embodiment, the cooling gas is flowing in the opposite direction to the effluent gas so to promote turbulence and mixing. In one embodiment, direct contact heat transfer is thus utilized so as to rapidly cool a heated, gaseous effluent stream.

In another embodiment, the cooling gas utilized is itself a recycled or closed-system component of a reactor system. In another embodiment, the cooling gas is $SiCl_4$. In another embodiment, the physical design aspects of the cooling unit itself facilitate the use of a gaseous cooling mechanism.

In another embodiment, the cooling gas is fully compatible with the reactor effluent stream which, in one embodiment, is primarily composed of trichlorosilane, $SiCl_4$, and hydrogen.

In one embodiment, the cooling gas is non-reactive with the reactor effluent stream.

In another embodiment, the cooling gas minimally reacts with the reactor effluent stream so as to produce no or minimal net effect on the reactor assembly.

In one embodiment, a suitable gas is utilized in cooling gases exiting a high-temperature reactor.

In another embodiment, the suitable gas is silicon tetrachloride.

In another embodiment, the suitable gas is any gas chemically compatible with the exiting gases and possessing sensible heat capacity adequate to cool heated, exiting gases.

In another embodiment, the suitable cooling gas is introduced into a reactor assembly as a cooling agent at a temperature of about 100 degrees Celsius.

In another embodiment, the suitable cooling gas is introduced into a reactor assembly as a cooling agent at a temperature of about 115 degrees Celsius. In another embodiment, the suitable cooling gas is introduced into a reactor assembly as a cooling agent at any temperature at which the cooling gas is in vapor phase.

In another embodiment, the total volume of space (cross-sectional reactor area) available for mixing of the suitable cooling gas and heated, exiting gases and subsequent cooling of the heated, exiting gases is sufficient to facilitate mixing of reactor effluent and cooling gases.

In another embodiment, the total volume of space (cross-sectional reactor area) available for mixing of the suitable cooling gas and heated, exiting gases and subsequent cooling of the heated, exiting gases is provided within the reactor or right after the reactor.

In another embodiment, addition of hydrogen as an auxiliary cooling agent is no longer required.

In some embodiments, a method of the instant invention for cooling a reaction effluent gas, includes a) feeding a sufficient amount of a suitable silicon source cooling gas into a stream of the reaction effluent gas, i) wherein the reaction effluent gas is produced by a thermal decomposition of at least one silicon source gas in a reactor, ii) wherein the stream of the reaction effluent is traveling in a confined area, iii) wherein the suitable silicon source cooling gas comprises at least one chemical species that is present in the reaction effluent gas, and iv) wherein sufficient amount of the suitable silicon source cooling gas is defined based a concentration of the at least one chemical species in the reaction effluent gas; b) cooling the reaction effluent gas to a sufficient temperature so that: i) the rate of the thermal decomposition of the at least one silicon source gas in the stream of the cooled reaction effluent gas is less than 5 percent, and ii) the cooled reaction effluent gas is capable of being handled by a material that is not suitable for handling the reaction effluent gas; and c) wherein the sufficient temperature is temperature range between about 450 degrees Celsius and about 700 degrees Celsius.

In some embodiments, the confined area is located outside of the reactor. In some embodiments, the confined area is located inside of the reactor.

Figure 2:
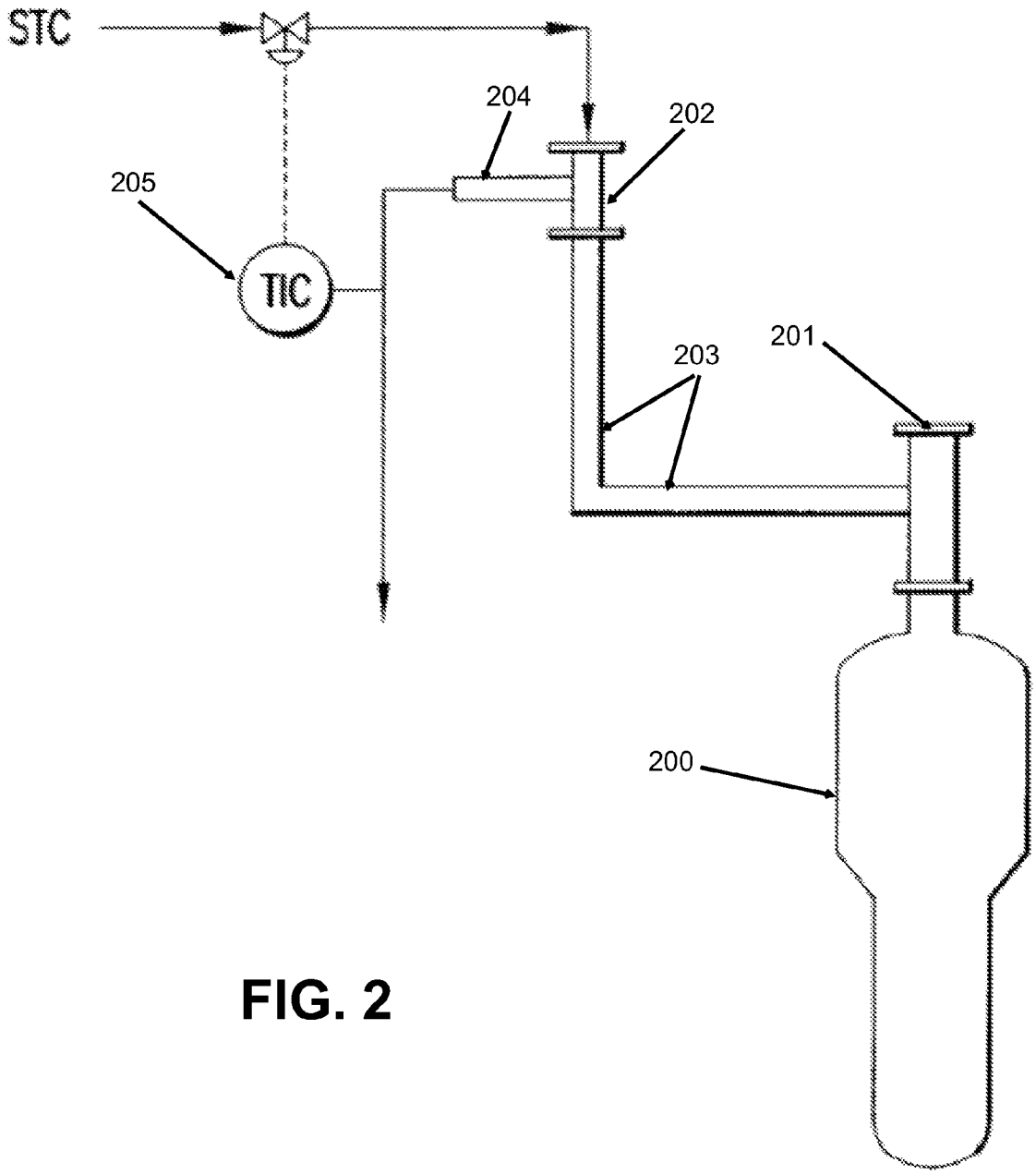
FIG. 2 depicts an embodiment of the present invention.

FIG. 2 is a schematic of a mechanism for cooling the exiting, heated reactor effluent gases in accordance with some embodiments of the instant invention. In one embodiment, the reaction takes place in a reactor 200. In one embodiment, the heated effluent gases exit the reactor 200 into a pipe 201. In one embodiment, STC is used as a suitable cooling gas. In one embodiment, STC is fed through a pipe 202 in a direction of the exiting heated effluent gas. In one embodiment, as STC advances in opposite direction along a pipe 203 and into the pipe 201, STC mixes with the effluent gases, heats up and absorbs some heat from the effluent gases, sufficiently cooling them to about desirable temperature. In one embodiment, its countermovement enables STC to be efficiently mixed with the exiting heated effluent gases. In one embodiment, the cooled gas mixture of effluent gases and STC exits through a pipe 204 in order to be distributed as needed. In one embodiment, a portion of the exiting cooled gas mixture is re-introduced through a feedback loop 205 into a feed of the incoming STC to heat STC to a suitable temperature that is required to achieve the desirable temperature of the exiting cooled gas mixture.

In another embodiment, the diameter of the pipes 201-203 through which the suitable cooling gas is introduced and cooling occurs vary from about 2" to about 7". In another embodiment, the diameter of the pipes 201-203 through which the suitable cooling gas is introduced and cooling occurs vary from about 1" to about 7". In another embodiment, the diameter of the pipes 201-203 through which the suitable cooling gas is introduced and cooling occurs vary from about 2" to about 5". In another embodiment, the diameter of the pipes 201-203 through which the suitable cooling gas is introduced and cooling occurs vary from about 2" to about 10".

In another embodiment, Sodium tetrachloride or another suitable compound in its gas form is used instead of STC. In another embodiment, for example, if Sodium tetrachloride is used, Silicon tetrachloride is vaporized in a start-up STV vaporizer, and is subsequently introduced through the pipe 202 into a heated gas removal system, in one embodiment flowing in the direction opposite that of the heated gas so as to promote turbulence and mixing of the gases.

In another embodiment, the diameter of the pipe into which the suitable cooling gas is introduced and cooling occurs is any suitable diameter sufficient to facilitate mixing of reactor effluent and cooling gases.

In another embodiment, the suitable cooling gas (e.g. STC) is introduced into a cooling piping system at a pressure of about 45 psig (pound per square inch) or lower. In another embodiment, the suitable cooling gas (e.g. STC) is introduced into a cooling piping system at a pressure of about 25 psig or higher. In another embodiment, the suitable cooling gas (e.g. STC) is introduced into a cooling piping system at a pressure of about 10 psig or higher. In another embodiment, the suitable cooling gas (e.g. STC) is introduced into a cooling piping system at a pressure of about 40 psig or higher. In another embodiment, the suitable cooling gas (e.g. STC) is introduced into a cooling piping system at a pressure of about 15 psig to 50 psig.

For some embodiments, experiments were run assessing (1) the relative effectiveness of the use of gas cooling outside of the reactor 200; and (2) the feasibility of using alternative, lower-cost materials in equipment down streamed from the reactor 200 and afferent and efferent gas conductivity portions of such assembly facilitated by the use of a novel and efficient gas cooling method. In one experiment, a cooling gas is introduced at any point subsequent to initial egress of the heated gases from the high temperature reactor 200. In one embodiment, the cooling gas is silicon tetrachloride. In another embodiment, the relative effectiveness of the cooling gas in cooling the heated gases is assayed by one or more criteria, including without limitation: temperature of heated gases subsequent to initial contact with cooling gas; time needed for a given volume of heated gases to be cooled to a certain critical temperature; relative ratio of cooling and heated gases, including minimum amount of cooling gases needed to attain a certain cooling profile; and/or relative decrease in adverse effect of heated and heated subsequently cooled gases on materials used for the construction of the associated structures.

In one example, an effluent gas of temperatures ranging up to 800-950 degrees Celsius is released from a reactor at a rate of approximately 1000-1500 lbs./hr. In another example, an effluent gas of temperatures ranging up to 700-950 degrees Celsius is released from a reactor at a rate of approximately 750-1500 lbs./hr. A cooling gas, for example silicon tetrachloride, is released into the same conduit travelling in the opposite direction and traveling at the rate of approximately 400-600 lbs./ hr. The resultant gaseous mixture is cooled to below 675 degrees Celsius.

Figure 3:
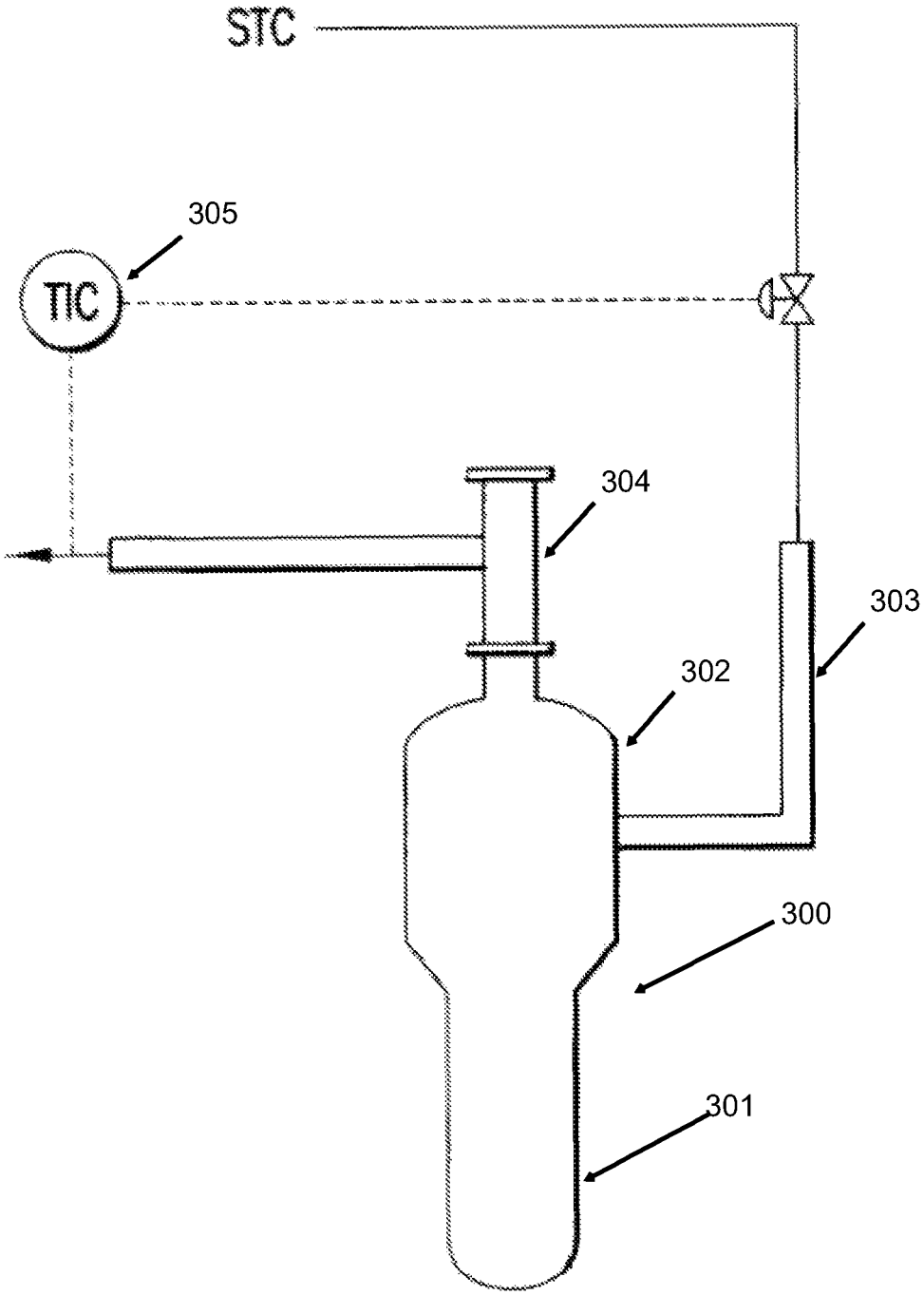
FIG. 3 depicts an embodiment of the present invention.

FIG. 3 is a schematic of a mechanism for cooling the effluent reaction gases within the confinement of a reactor 300 in accordance with some embodiments of the instant invention. In one embodiment, the decomposition of TCS takes place in the reactor 300, specifically within a section 301 of the reactor 300. In one embodiment, the heated effluent gases exit a reaction zone of the section 301 and ascend to a section 302 of the reactor. In one embodiment, STC is used as a suitable cooling gas. In one embodiment, STC is fed through a pipe 303 into the section 302 of the reactor 300. In one embodiment, the pipe 303 extends into a space of the section 302 to deliver STC closer to a central vertical axis of the reactor 301. In one embodiment, STC is direct in an opposite direction to the effluent stream. In one embodiment, STC is fed in a substantially perpendicular direction to the effluent stream. In one embodiment, STC mixes with the effluent gases, heats up and absorbs some heat from the effluent gases, sufficiently cooling them to about desirable temperature. In one embodiment, its countermovement enables STC to be efficiently mixed with the heated effluent gases within the section 302 of the reactor 300. In one embodiment, the cooled gas mixture of effluent gases and STC exits through a pipe 304 in order to be distributed as needed. In one embodiment, a portion of the exiting cooled gas mixture is re-introduced through a feedback loop 305 into a feed of the incoming STC to heat STC to a suitable temperature that is required to achieve the desirable temperature of the exiting cooled gas mixture.

In one embodiment, the heated effluent gases escaped the reaction zone of the section 301 of the reactor 300 at a pressure of about 19 psig, a temperature of about 875 degrees Celsius and rates for at least two primary components as follows: STC had a rate of about 700 lbs/hr (pounds in hour) and TCS had about 250 lbs/hr. In one embodiment, a mixture of STC and TCS was used as a cooling gas. In one embodiment, the cooling mixture was supplied at a pressure of about 45 psig, a temperature of about 115 degrees Celsius and rates for TCS and STC as follows: STC had a rate of about 425 lbs/hr and TCS is about 15 lbs/hr. In one embodiment, the resulted cooled effluent gas mixture that exited the reactor 300 had the following characteristics: a pressure of about 20 psig, a temperature of about 670 degrees Celsius and rates (STC was about 1125 lbs/hr and TCS was about 260 lbs/hr).

In another embodiment, a suitable cooling gas is introduced into the section 302 of the reactor 300 as a cooling agent at a pressure of about 35 psig or higher. In another embodiment, a suitable cooling gas is introduced into the section 302 of the reactor 300 as a cooling agent at a pressure of about 50 psig or higher. In another embodiment, a suitable cooling gas is introduced into the section 302 of the reactor 300 as a cooling agent at a pressure of about 5 psig or higher. In another embodiment, a suitable cooling gas is introduced into the section 302 of the reactor 300 as a cooling agent at a pressure of about 5-65 psig. In another embodiment, a suitable cooling gas is introduced into the section 302 of the reactor 300 as a cooling agent at a pressure of about 15-55 psig.

For some embodiments, experiments were run assessing (1) the relative effectiveness of the use of gas cooling in the reactor 300; and (2) the feasibility of using alternative, lower-cost materials in portions of the reactor 300 and afferent and efferent gas conductivity portions of such assembly facilitated by the use of the instant novel and efficient gas cooling method. In one experiment, a cooling gas is introduced at any point subsequent to initial egress of the heated gases from the high temperature reaction zone 301 of the reactor 300. In one embodiment, the cooling gas is sodium tetrachloride. In another embodiment, the relative effectiveness of the cooling gas in cooling the heated gases is assayed by one or more criteria, including without limitation: temperature of heated gases subsequent to initial contact with cooling gas; time needed for a given volume of heated gases to be cooled to a certain critical temperature; relative ratio of cooling and heated gases, including minimum amount of cooling gases needed to attain a certain cooling profile; and/or relative decrease in adverse effect of heated and heated subsequently cooled gases on materials used for the construction of the reactor and associated structures.

While a number of embodiments of the present invention have been described, it is understood that these embodiments are illustrative only, and not restrictive, and that many modifications and/or alternative embodiments may become apparent to those of ordinary skill in the art. For example, any steps may be performed in any desired order (and any desired steps may be added and/or any desired steps may be deleted). Therefore, it will be understood that the appended claims are intended to cover all such modifications and embodiments that come within the spirit and scope of the present invention.

We claim:

1. A method for cooling a reaction effluent gas, comprising:

a) feeding a sufficient amount of a cooling gas into a stream of the reaction effluent gas, i) wherein the reaction effluent gas is produced by a thermal decomposition of at least one silicon source gas in a reactor, ii) wherein the stream of the reaction effluent is traveling in a confined area;

iii) wherein the cooling gas comprises at least one chemical species that is present in the reaction effluent gas, and iv) wherein sufficient amount of the cooling gas is defined based a concentration of the at least one chemical species in the reaction effluent gas;

b) cooling the reaction effluent gas to a sufficient temperature so that:

i) the rate of the thermal decomposition of the at least one silicon source gas in the stream of the cooled reaction effluent gas is less than 5 percent, and ii) the cooled reaction effluent gas is capable of being handled by a material that is not suitable for handling the reaction effluent gas; and c) wherein the sufficient temperature is temperature range between about 450 degrees Celsius and about 700 degrees Celsius.

2. The method of claim 1, wherein the confined area is located outside of the reactor.

3. The method of claim 1, wherein the confined area is located inside of the reactor.

* * * * *